United States Patent [19]

Erickson et al.

[11] 4,216,785

[45] Aug. 12, 1980

[54] WATER PIPE OR BONG

[75] Inventors: William V. Erickson; Paul K. Jarvie, both of Salt Lake City, Utah; Fred L. Miller, 7417 S. State St., Midvale, Utah 84047

[73] Assignee: Fred Lynn Miller, Midvale, Utah

[21] Appl. No.: 827,691

[22] Filed: Aug. 25, 1977

[51] Int. Cl.[3] ..... A24F 1/14; A24F 1/30

[52] U.S. Cl. ..... 131/173; 131/198 R

[58] Field of Search ..... 131/173, 198, 196, 223; D27/3

[56] References Cited

U.S. PATENT DOCUMENTS

| | | | |
|---|---|---|---|
| 848,424 | 3/1907 | Abizaid | 131/173 |
| 3,863,640 | 2/1975 | Kahler | 131/173 |
| 3,881,499 | 5/1975 | McFadden et al. | D27/3 X |
| 3,882,875 | 5/1975 | Frost | 131/229 X |
| 4,044,781 | 8/1977 | Heggestuen | 131/223 X |

*Primary Examiner*—Stephen C. Pellegrino
*Attorney, Agent, or Firm*—A. Ray Osburn

[57] ABSTRACT

An improved smoking water pipe or bong comprising a chamber containing water in its lower portion, its upper portion serving as a smoke collection reservoir; a bowl for combusting tobacco or medicinal herbs, the smoke directed through a tube to the water chamber below the water; a finger controllable orifice for admitting air through a tube to a point below the surface of the water; and a mouth piece for applying suction to the interior of the chamber to inhale the smoke. In accordance with one aspect of the disclosure, a separate second chamber may be provided as the smoke reservoir, appropriate fluid communication tubes being provided between the chambers, and the smoke reservoir carrying the mouthpiece. The disclosed water pipe or bong permits the control of atmospheric air to function and a gas piston to move the smoke in the smoke reservoir uniformly and without dilution into the mouth of the smoker, and to provide a following draught of cooled and moistened air. Thus greater control and selectivity is provided the smoker to his increased pleasure and enjoyment.

24 Claims, 2 Drawing Figures

WATER PIPE OR BONG

BACKGROUND

1. Field of Invention

The present invention relates broadly to apparatus by which a smoker may inhale the products of combustion of combustible substances such as tobacco and medicinal herbs, and more particluarly to apparatus by which the smoke is drawn through water or other liquid before being inhaled. With still more particularity, the present invention relates to the foregoing apparatus which has provisions for utilization of atmospheric air to complement and aid the smoking process.

2. Prior Art

The use of water in smoking apparatus is ancient, dating back at least several hundred years. Illustrative examples of early smoking water pipes are the Persian hookahs or narghiles, wherein smoke from the substance being combusted is directed through a tube discharging below the surface of water in a potlike container before passing therefrom through a second tube to the mouth of the smoker. Such apparatus undoubtedly did provide the function of cooling and cleansing the smoke of ash, tars and other contaminants. More recently, various modern versions of the ancient water pipes have been manufactured, sold and used. These versions have not differed in basic respect from the original hookah, comprising principally a potlike container for holding the water, a bowl for the smoking substance communicating by a hollow tube to a point beneath the water, and an outlet tube from a smoke chamber formed above the surface of the water to the mouth of the smoker. These modern versions of the hookah have been produced in forms not adaptable to being carried by the smoker, as well as in more compact, smaller portable versions. They have not incorporated provisions for the use of atmospheric air to control the smoke. More recently, probably under the influence of the oriental smoking water pipe called a bong, using the hollow stem of the bamboo tree as a combined water and smoke chamber, modern versions of a water pipe have been produced of a general cylindrical tubular construction. In these versions, tubes of plastic and other modern materials have replaced the aforesaid hollow bamboo stem. The oriental bong, further, provides means for using atmospheric air to dilute the smoke before inhalation, as well as provided oxygen for the combustion producing the smoke. Thus, an air admitting orifice has been provided venting the smoke chamber formed in the bamboo stem above the water in the bottom of the stem. The orifice is finger controllable, so that air may at the desire of the smoker be either excluded or admitted directly to the smoke chamber so as to dilute the smoke therein. U.S. Pat. No. 3,882,875 provides a vented potlike vessel to contain water and provide a smoke chamber above the water, the smoke chamber being provided with finger controllable vents for the use of the smoker in diluting the smoke. U.S. Pat. No. 3,881,499 represents a cylindrically constructed water pipe or bong, having sedimentation chambers housed in the lower part of a tube which also forms a water and smoke chamber thereabove. However, no provision is made for the utilization of atmospheric air to dilute or control the smoke in ways other than combusting and transporting the smoke in and from a smoking bowl. The smoke is cleansed of ash and other contaminants by the sedimentation chambers, but must be inhaled in the character and strength with which it is formed by combustion in the bowl. Thus, all current art of water pipes provide inadequate control over the nature, concentration and mode of delivery of the smoke to the mouth of the smoker, failing to provide for the use of atmospheric air selectively to dilute and positively displace the smoke, nor to sooth and cool the throat and bronchial passages of the smoker after the smoke is inhaled.

BRIEF SUMMARY AND OBJECTS OF THE INVENTION

With the foregoing in mind, the present invention prevents or substantially alleviates the aforesaid disadvantages of the prior art in water pipes and bongs by providing means whereby atmospheric air may be utilized to selectively dilute or displace the smoke being inhaled by the smoker. Further, the present invention provides also for the cooling, soothing and restoration of the throat and bronchial passages of the smoker to a comfortable condition by alleviating the caustic effects of the smoke inhaled.

Accordingly, it is a primary object of the present invention to provide a novel and improved water pipe or bong for smoking tobacco or medicinal herbs.

A paramount object of the invention is to provide a reservoir of smoke to be inhaled which is of controlled uniform quality.

Another paramount object of the invention is to provide a water pipe or bong which provides for the controlled admission of atmospheric air into water contained in said bong and thence into the smoke chamber.

A primary object of the invention is to provide finger controllable means of controlling the admission of air into a bong or water pipe at a point beneath the surface of water contained in said bong or water pipe.

A further paramount object of the invention is to provide a water pipe or bong whereby a volume of selectively controlled smoke may be inhaled without dilution or variation thereof during the inhalation.

A further primary object of the invention is to provide a chamber for containing smoke to be inhaled, said chamber so shaped that smoke may be displaced before a front of atmospheric air without significant mixing therewith.

Another important object of the invention is to provide a bong which can be designed to permit the smoker to completely shut of the flow of smoke into the bong while the smoker continues to inhale.

Still another important object of the invention is to permit the smoker to inhale purified draughts of cooled smoke of selective size, also permitting said draughts to be followed by draughts of smoke free, cooled and moistened air.

A further object of the invention is to provide for the subsequent cooling and soothing of the throat and bronchial passages immediately after the smoke is inhaled.

Another further object of the invention is to provide a generally cylindrical bong or water pipe of a size and extension readily accomodated by the smoker.

A further object of the invention is to provide a separate water containing chamber for sedimentation and cooling of the smoke before the smoke enters a smoke inhalation chamber.

A further object of the present invention is to provide a transparent smoke chamber and transparent smoke and air transportation tubes and passages.

A further object of the invention in to provide a water pipe or bong comprising a vertically extending tube which is free standing for the convenience of the smoker.

A further object of the invention is to provide a water pipe or bong whereby atmospheric air may be used to selectively dilute the smoke to be inhaled and then to displace said diluted smoke without further dilution into the mouth of the smoker.

A further object of the invention is to provide a water pipe or bong which may be economically constructed of readily available components and materials.

These and further objects and advantages of the present invention will be apparent from the following detailed description of illustrated embodiments of the invention made with reference to the accompanying drawings.

DETAILED DESCRIPTION OF ILLUSTRATED EMBODIMENTS

FIRST PREFERRED EMBODIMENT

Figure 1:
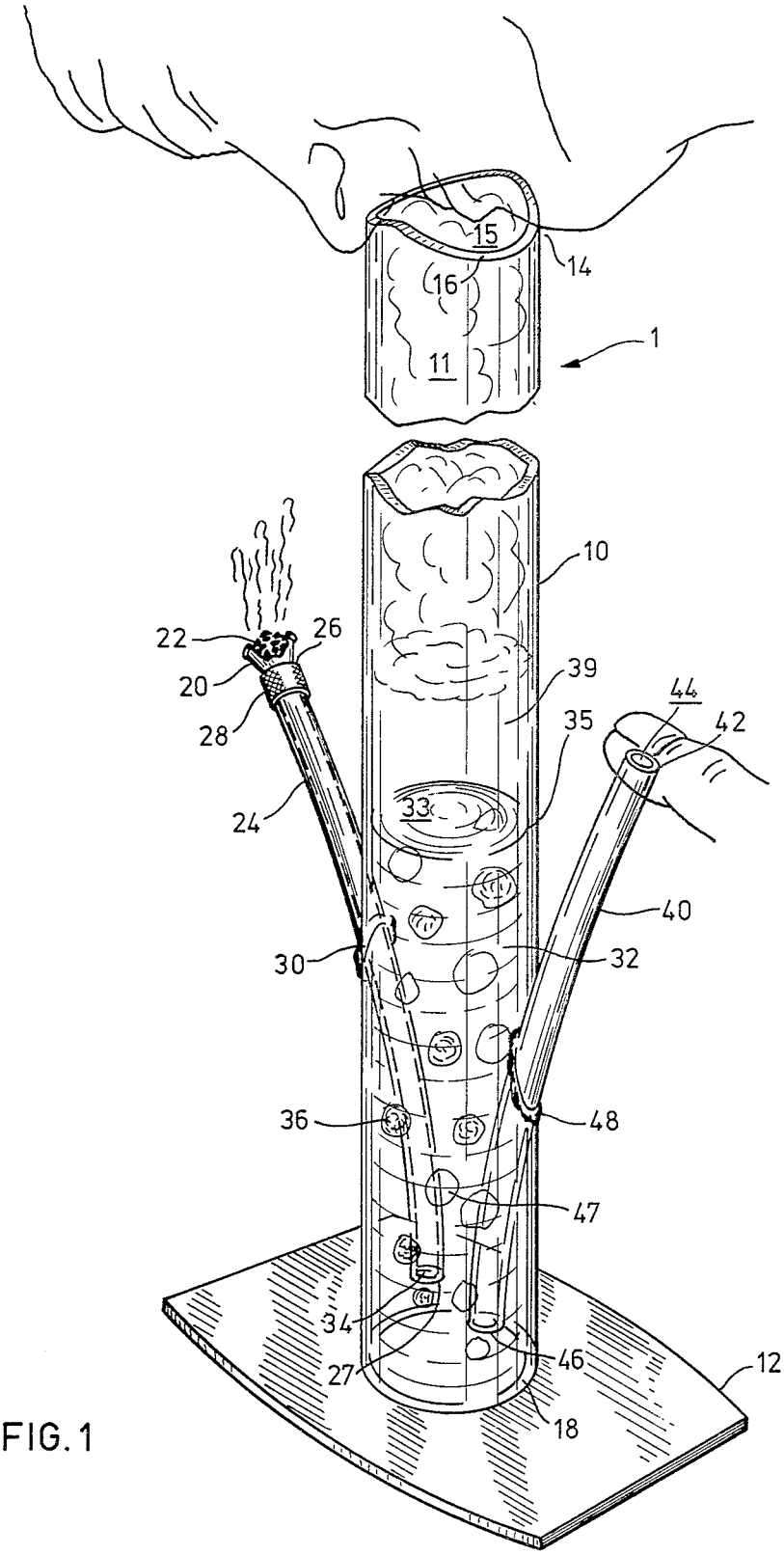
FIG. 1 is a perspective representation of a first preferred embodiment in accordance with the principles of the invention, comprising a single tubular member for the water and smoke chambers.

Reference is now made to the Figures, wherein like parts are designated by like numerals throughout. FIG. 1 in particular illustrates a first preferred embodiment of a smoking water pipe or bong generally designated 1, comprising a generally cylindrical tubular member 10 disposed vertically upon a base 12, the lowermost terminus of said tube 10 being bonded or otherwise sealably secured to the base 12. An uppermost terminus of the tube 10 provides end opening 15 to receive the mouth and lips of the smoker as indicated in FIG. 1. A cylindrical wall 16 of the tube 10 may be shaped at an uppermost end 14, as shown, to comfortably accommodate the face of the smoker. The smoker may thereby inhale and create a suction upon the contents of the tube 10, in a manner and for a purpose hereinafter described in detail.

A lower portion of the tube 10 is, in preparation for the use of the smoker, filled with water or other liquid 32 to a level 35. The water 32 occupying the lower portion of the tube 10 creates above its surface 33 a smoke chamber 11.

The tube 10 carries a smoke inlet tube 24 upon which is mounted a bowl 20 for combusting tobacco or other smoking substance 22 therein. The bowl 20 is secured to the tube 24 by a nut 26 carrying internal threads, not shown, and external knurls 28. Mating threads, not shown, carried externally by a lower portion of the bowl 20 and the upper extremity of the tube 24 are engaged by the threads of nut 26 to secure the bowl 20 to the tube 24. The tube 24 provides an internal passage terminating in a smoke outlet 34 beneath the surface 33 of the water 32 at a point near the bottom 18 of the tube 10. The tube 24 is in sealed relation to the wall 16 of the tube 10 by water resistant bonding material 30 applied at the juncture of the wall 16 of the tube 10 and the tube 24. As described hereinafter, during operation of the bong 1, smoke is drawn through the passage of the tube 24 from the bowl 20 and emerges as bubbles from the lower end 34 of the tube 24.

The tube 10 carries a second tube 40 which serves to admit air in the lower portion 32 of the tube 10 during certain stages of operation of the bong 1. An uppermost extension 42 of the tube 40 forms and air admitting orifice 44 which can be controlled by the thumb of the smoker as indicated in FIG. 1. The tube 40 is in sealed relation to the tube 10 from the application of sealing material 48. During operation of the bong 1, as hereinafter more fully described, atmospheric air travels through the passage 44 in the tube 40 to emerge as bubbles 47 from an end 46 of the tube 40 into the water 32 near the lower end 18 of the tube 10.

OPERATION OF THE BONG 1

Referring still to FIG. 1, the method of operation of the water pipe or bong 1 is now described. The operator places combustible substance 22 into the bowl 20 and applies a lighted match, lighter or the like thereto while drawing upon the open end 15 of the tube 10, thereby drawing air through the tobacco 22 until it is ignited and produces smoke. Medicinal herbs may be employed in place of the tobacco in the bowl 20. While the substance 22 is being ignited, the smoker excludes air from entering the tube 40 by placing a thumb or finger over the air admitting orifice 44 of the tube 40, or otherwise closing it.

After the material 22 is ignited as described above, the smoker may exhale and then again place his mouth upon the end 14 of the tube 10, and then draw upon the tube 10 while excluding air from the bong 1 by holding a thumb upon the end 42 of the tube 40. As the smoker thus draws upon the tube 10, smoke from the bowl 20 is drawn through the opening 34 in the tube 24 and emerges as bubbles 36 from the end 27 of the tube 24. The bubbles 36 of smoke are then buoyed upwardly through the water 32 in the lower portion of the tube 10, thereafter arriving into to the chamber 11. Thus, a volume of smoke is formed in the chamber 11, cooled and freed of ash, tar and other comtaminants by its passage through the water 32.

The smoker may at this time remove his mouth from the bong 1 and exhale, or he may continue to draw upon the mouthpiece 14. As he continues to inhale, he now removes his thumb or finger from the orifice 44, allowing atmospheric air to travel through the passage 44 in the tube 40 to exit from the end 46 to be then buoyed upwardly as bubbles 47 to the surface 33 of the water 32. This air admitted to the bong 1 through the tube 40 is cooled and moistened by passing through the water 32. Passage 44 may be provided sufficiently great in area that only smoke free air will enter chamber 11 at this stage, since the bowl 20 will normally have a comparatively restricted smoke outlet opening offering much greater resistance to the flow of air than does the much larger passage 44. However, if the individual smoker so desires, a smaller passage 44 may be provided so that some amount of air may enter the bong 1 by way of the bowl 20 along with smoke therefrom.

As the bubbles 47 emerge from the surface 33 of the water 32, the air contained in the bubbles 47 diffuses and unites into a continuous horizontal layer 39 lateral to the tube 10. This layer 39 grows in vertical dimension as the smoker continues to draw upon the tube 10, and does not mix to any significant degree with the volume of smoke in the chamber 11 of the tube 10. Thus the volume of smoke in chamber 11, as the smoker continues to inhale, moves smoothly and uniformly without dilution by the incoming air into the mouth of the smoker, and thence through bronchial passages to the lungs of the smoker. The smoker therefore inhales an extended and substantially uniform draught of smoke pleasurably into his lungs. In contrast to the bong 1, other water pipes and bongs hereinbefore described with air admitting orifices directly into the smoke containing chamber 11 above the surface 33 of the water 32 provide the smoker with a draught of smoke successively diluted and weakened as the smoker continues to inhale. This is because air admitted into the chamber 11 through the side wall thereof strongly tends to mix with and dilute the smoke therein. The smoker using such a bong accordingly never completely exhausts the chamber 11 of all smoke.

With the bong 1, after the smoker has inhaled the volume of smoke from chamber 11, he may continue to draw upon the bong 1, thereby inhaling a following draught consisting of the cooled and moistened air which has displaced the smoke he has previously inhaled. This subsequent draught, free of smoke, cool and damp, provides soothing relief, if needed, from any caustic or stringent effects of the smoke upon his throat and bronchial membranes.

PROPORTIONS OF THE BONG 1

The bong 1 may be selected in size and proportions in accordance with the individual smoker's desires. However, experimentation has shown that a suitable diameter for the tube 10 is 2 inches, such a size providing a mouthpiece end 15 which will comfortably fit the face of the smoker. A tube 10 of such a size will, within a manageable length of 18 to 24 inches, provide 6 to 8 inches of water depth to sufficiently cool and purify the smoke. The chamber 11 above the surface 33 of the water 32 may then be up to 18 inches in height, suitable to provide a volume therein suitable to be accommodated by the lungs of the average smoker.

The tube 40 may have the interior passage 44 in the neighborhood of ¼ to ½ inches in diameter, or larger, and no appreciable resistance is offered to the suction provided by the smoker to draw air into the bong, while the smoke opening in the bowl 20 may be much smaller, such as 1/32 to 3/64 inches in diameter. The air outlet end 46 of the tube 40 may be positioned near the bottom of the tube 10, as shown in FIG. 1, or may be located near to the surface of the water 32. Location of the opening 46 near the bottom of the tube 10 tends to pro the greater cooling and moistening of the air. However, sufficient cooling and dampening is provided if the opening is located only 1 or 2 inches below the surface 33 of the water 32. This latter positioning of the opening 46 tends to reduce the amount of frothing and churning of the water 32 in case the air is admitted incautiously.

it is desireable and efficient to use cylindrical tubular members to form the water and smoke containing chamber. However, chambers otherwise shaped may be used without departing from the spirit of the invention, so long as such shapes are chosen to be consistent with the operation of the water pipe or bong as herein described. Thus, the uniform displacement and inhalation of smoke could be preserved by the use of a chamber 11 which tapered from larger to smaller in the vertical direction. However, the use of an extremely bulbous of pot shaped smoke chamber would tend to defeat this feature of the operation. As a further example, a pot or bulb shaped water chamber could probably be employed, but such a chamber would more desireably be shaped to blend smoothly at the surface of the water with the lowermost extension of the smoke inhalation chamber.

It is clear that a variety of designs could be employed for the mouthpiece 14 without departing from the spirit of the invention. For example, the tube 10 could be narrowed at the end 14, so that the lips of the smoker could embrace, rather than be embraced, by the mouthpiece as in the illustrated embodiments.

it should also be understood that the liquid water 32 may be replaced with any other liquid at the desire of the smoker. The smoker may choose to use wine, fruit juice or various alchohol containing liquids compatible with the system of the smoker. Liquids may be chosen to add flavor to the smoke of the tobacco or medicinal herbs used in the bong 1.

SECOND PREFERRED EMBODIMENT

Figure 2:
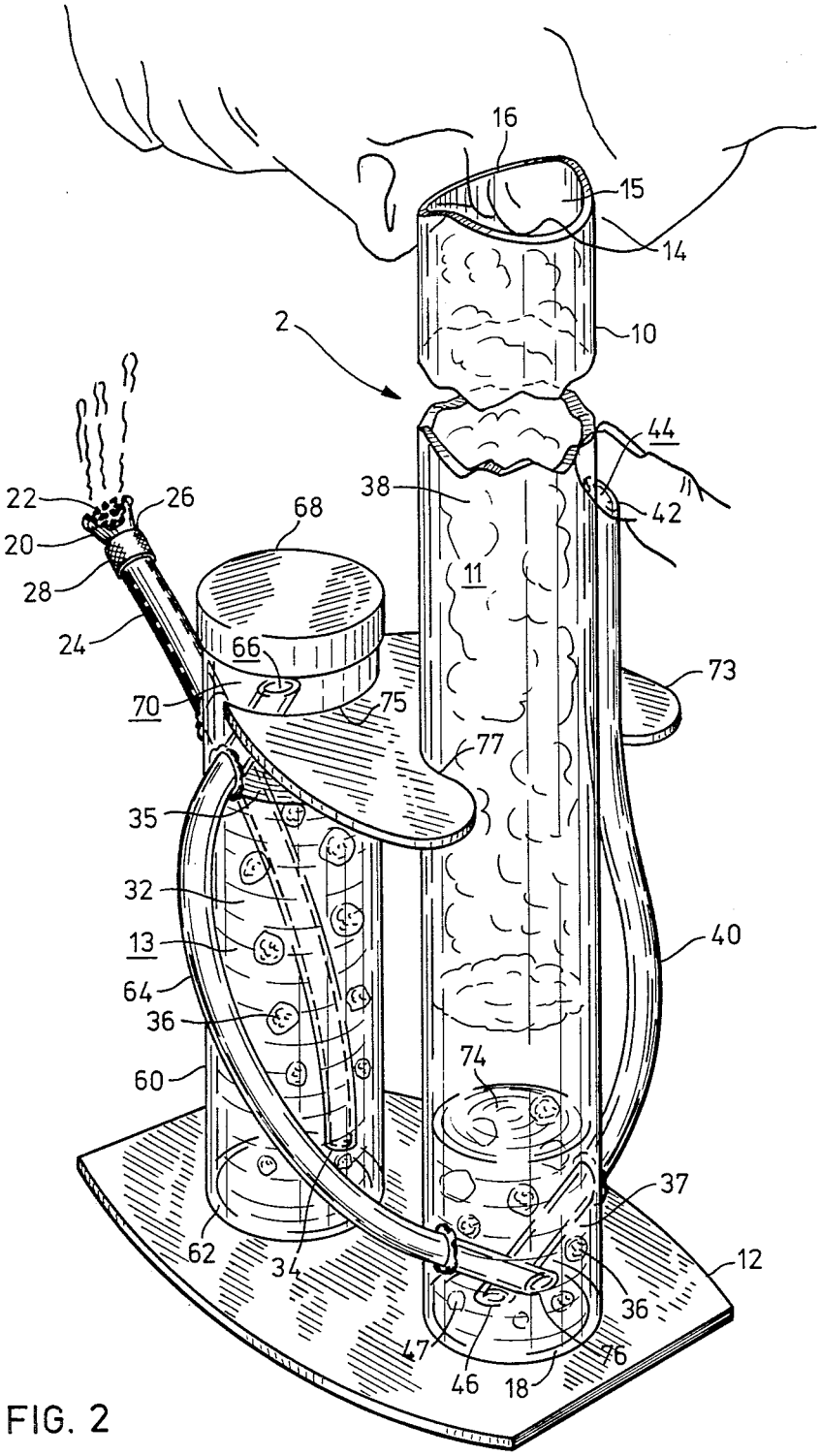
FIG. 2 is a perspective representation of a second equally preferred embodiment in accordance with the principles of the invention, generally comprising separate chambers for containing water and collecting smoke, and fluid communication means therebetween.

A second and equally preferred embodiment of the water pipe or bong is illustrated in FIG. 2, generally designated 2. A tube 10 similar to that of the bong 1, is employed, bonded sealably to the base 12 at a lowermost end 18 of the tube 10. A secnd tubular member 60 is provided, also vertically disposed on the base 12 and sealably bonded thereto at a lowermost end 62 of the tube 60. A smoking tube 24 is utilized in association with the tube 60, carrying a bowl 20 at its uppermost end, and discharging near the bottom of the chamber 13 formed by the tube 60. A tube 64 having a passage 66 throughout its length, provides fluid communication from a point near the top of the chamber 13 and the interior of the lowermost extension of the tube 10. A cap 68 frictionally engages the exterior circumference of the uppermost portion of tube 60, and provides a fluid tight juncture therewith. Water or other fluid 32 is placed in the chamber 12. The water 32 is filled to the level 35 in the chamber 12, leaving a relatively small free volume 70 thereabove. A second volume of fluid 37 is placed in a relatively small portion of the chamber 11 formed by the tube 10 and the base 12, to a level 74 therein.

An atmospheric air tube 40 is provided in sealable relation to the tube 10, providing an air admitting orifice 44 at an uppermost end 42 thereof, and a lower end 46 serving as an outlet for atmospheric air into the water 37 in the tube 10. The tubes 40, 64 and 24 are all in sealable relation to the walls of the chambers 10 and 60.

The tube 10 carries on its uppermost extension 14 a mouthpiece formed by the walls 16 of the tube 10, shaped to accommodate the mouth and lips of the smoker. A connecting member 73 connects and stabilizes the tubes 10 and 60, being bonded to the walls of the tubes 60 and 10 at junctures 75 and 77 respectively.

OPERATION OF THE BONG 2

The operation of the bong 2, shown in FIG. 2, is similar to that of the bong 1, previously described. Tobacco or other suitable combustible substance 22 is placed in the bowl 20 and a match, lighter or other ignition source applied thereto while the smoker draws upon the mouthpiece end 14 of the tube 10. As the smoker draws upon the mouthpiece 14, he closes the air opening 44 with a thumb, and a partial vacuum is created in the chamber 11. This vacuum is communicated to the chamber 13 through the opening 66 in the tube 64, and thence to the opening 34 in the tube 24. Thus, air is drawn through the substance 22 to provide oxygen for its combustion to produce smoke. After the tobacco 22 is ignited, the smoker may continue to draw on the mouthpiece 14, drawing smoke through the tube 24 to travel upwardly in the form of bubbles 36 to the chamber 70, and thence through the opening 66 in the tube 64 to the water 37 in the bottom of the tube 10. The smoke bubbles 36 then exit from the end 76 of the tube 64 and are the buoyed upwardly to the surface 74 of the water 37 in the tube 10 to fill the chamber 11 with smoke. This smoke now in the chamber 11 has been cooled and dampened and cleansed by the water 32 and 37 in the tubes 10 and 60.

The smoker may at this point in the smoking sequence remove his mounth from the tube 10, exhale, and reengage the mouthpiece 14 with his mouth and proceed to draw upon the mouthpiece to inhale the smoke in chamber 11. As he does so, he removes his thumb from the air admitting orifice 44, so that atmospheric air is drawn into the tube 10, displacing and replacing the smoke in chamber 11 as described hereinbefore for the operation of the bong 1. The smoke is moved uniformly before the air, to be inhaled as a draught of undiluted smoke uniform throughout the inhalation. Again, the air does not mix appreciably with the smoke, but only displaces it as it is inhaled.

After the smoker has inhaled the complete volume of smoke contained in chamber 11, he may continue to draw upon the mouthpiece 14 and thereby inhale a second draught of fluid being smoke-free, cooled and moisturized, with the soothing effects hereinbefore described.

As with the bong 1, the air admitting tube 40 may have an opening 44 in the range of ¼ to ½ inches or larger in diameter, so that the flow of smoke into the bong 2 will be substantially cut off when the opening 44 is exposed, as hereinbefore detailed for the bong 1.

The second preferred embodiment of the water pipe or bong illustrated in FIG. 2 provides a substantially larger smoke reservoir 11 than does the first preferred embodiment within a manageable height, since the bulk of the water is contained in the auxiliary chamber 13 in the second tube 60. Also, the above mentioned problem of the frothing and churning is alleviated, because of the relative smallness of the volume of the water 37 and the water 32 of bong 1.

It is clear that the smoker may, with either bong 1 or bong 2, choose to mix smoke and air to achieve a desired dilution of the smoke as it enters the smoke chamber 11. This may be done by the smoker by partially restricting the opening 44 to such a degree that smoke from the bowl 20 and air through the tube 40 simultaneously enter the bong to mix together as they enter the chamber 11. In this manner, the smoker may achieve a concentration of smoke to be inhaled which is suit to his taste. This may be accomplished without sacrifice of the intake of a uniform volume of smoke as hereinbefore described, since the smoker may entirely expose the air admitting orifice 44 before actual inhalation. Then the actual inhalation will be accomplished entirely as hereinbefore described.

The bong 2 may also be proportioned to satisfy the desires of the individual smoker. Again, it has been found that the tube 10 is generally suitable if about 2 inches in diameter. The tube 60 may be of the same size, and may extend vertically 6 to 8 inches. A total height for the bong 2 of 18 to 24 inches is generally suitable and manageable.

As indicated in both FIGS. 1 and 2, the chamber forming tubes 10 and 60 may be transparent, so that the smoker may observe the passage, bubbling and accumulation of the smoke during the above described smoking sequences. The air admitting tube 40 and the smoke communication tube 64 may also be transparent, and for the same reason. It is clear however that the use of opaque members would not in any way depart from the spirit of the invention.

The embodiments of the present invention presented herein are for illustrative purposes only and are not intended to restrict the scope of the invention in any way, any embodiment of the invention within the scope and breadth of the appended claims being intended to be embraced thereby. All embodiments within the meaning and range of equivalency of the appended claims are intended to be embraced therein. The invention may be embodied in other specific forms than those illustrated or mentioned herein without departing from the spirit or essential characteristics thereof.

What is claimed and desired to be protected by United States Letters Patent is:

1. A water pipe or bong comprising:

a chamber having a lower portion adapted to contain water and an upper portion adapted to form with the surface of the water a liquid free generally enclosed space for collecting and containing smoke, an upwardly disposed bowl wherein a suitable substance may be combusted to produce smoke, controllable tubular fluid communication means for the smoker to selectively cause smoke from the bowl and air from the atmosphere to be directed sequentially or simultaneously to the interior of chamber below the surface of the water therein, said means carrying at least one finger controllable orifice communicating between the atmosphere and the interior of said means, the orifice being generally closed by the smoker to direct smoke to the chamber and generally opened by the smoker to direct air to the chamber, and mouthpiece means carried by the upper portion of the chamber, so that the smoker may apply suction to the interior of the chamber.

2. A water pipe or bong comprising:

a chamber having a lower portion adapted to contain water and an upper portion adapted to form with the surface of the water a liquid free generally enclosed space for collecting and containing smoke, an upwardly disposed bowl wherein a suitable substance may be combusted to produce smoke, first tubular fluid communication means directing smoke from the bowl to the interior of the chamber below the surface of the water therein, second tubular fluid communication means directing atmospheric air to the interior of the chamber below the surface of the water therein, said means having at least one finger controllable air admitting orifice means, and mouthpiece means carried by the upper portion of the chamber, so that a smoker may apply suction to the interior of the chamber, said first and second tubular means permitting the smoker to cause smoke from the bowl and air from the atmosphere to be directed sequentially or simultaneously to the interior of the chamber below the surface of the water therein.

3. A water pipe or bong comprising:

a chamber having a lower portion adapted to contain water and a substantially cylindrical upper portion adapted to form with the surface of the water a liquid free generally enclosed space for collecting and containing smoke, an upwardly disposed bowl wherein a suitable substance may be combusted to produce smoke, a first tubular fluid communication means directing smoke from the bowl to the interior of the chamber below the surface of the water therein, a second tubular fluid communication means directing atmospheric air to the interior of chamber below the surface of the water therein, said means having at least one finger controllable air admitting orifice, and mouthpiece means carried by the uppermost extension of the cylndrical upper portion of the chamber, so that a smoker may apply suction to the interior of the chamber, said first and secnd tubular means permitting the smoker to cause smoke from the bowl and air from the atmosphere to be directed sequentially or simultaneously to the interior of the chamber below the surface of the water therein.

4. A water pipe or bong comprising:

a vertically disposed cylindrical tubular member sealably mounted upon a base, so that water may be contained in a lower portion of the member.

an upwardly disposed bowl wherein a suitable substance may be combusted to produce smoke, a first tubular means directing smoke from the bowl to the interior of the member below the surface of the water therein, a second tubular means directing atmospheric air to the interior of the member below the surface of the water therein, said means having at least one finger controllable air admitting orifice means, and mouthpiece means carried by the uppermost extension of the member, so that a smoker may apply suction to the interior of the member, said first and second tubular means permitting the smoker to cause smoke from the bowl and air from the atmosphere to be directed sequentially or simultaneously to the interior of the chamber below the surface of the water therein.

5. The apparatus of claim 4 wherein:

the second tubular means directs atmospheric air to a point near the botton of the water in the member.

6. The apparatus of claim 4 wherein:

the second tubular means directs atmospheric air to a point below and near the surface of the water in the member.

7. The apparatus of claim 4 wherein:

the uppermost extension of the member is truncated perpendicular to the longitudinal axis of the member, so that the walls of the member form a planar mouthpiece.

8. The apparatus of claim 4 wherein:

the uppermost extension of the member is shaped so that the walls of the member form a mouthpiece comfortably conforming to the face around the mouth of the smoker.

9. The apparatus of claim 4 wherein:

the uppermost extension of the member is shaped to form a mouthpiece adapted to accept the mouth of the smoker therearound.

10. The apparatus of claim 4 wherein:

the base is of a size and extension suitable to render the water pipe free standing.

11. The apparatus of claim 4 wherein:

the tubular member is comprised of transparent palstic material.

12. The apparatus of claim 4 wherein:

the first and second tubular means are comprised of transparent plastic material.

13. The apparatus of claim 4 wherein:

the second tubular means is of a size to provide substantially greater fluid flow area and therefore substantially less resistance to fluid flow than provided by the first tubular means, so that the flow of smoke is substantially completely terminated when the second tubular means is opened to the free flow of atmospheric air therethrough.

14. A water pipe or bong comprising:

a first chamber adapted to contain water in a lower portion thereof and forming with the surface of the water a generally closed liquid free space above the water, an upwardly disposed bowl for combusting a suitable smoke producing substance therein, first tubular means directing smoke form the bowl to the interior of the first chamber below the surface of the water therein, a second chamber adapted to contain water in a lower portion thereof and forming with the surface of the water a generally closed liquid free space thereabove, second tubular means directing smoke from the free space of the first chamber to the lower portion of the second chamber below the surface of the water therein, third tubular means directing atmospheric air to the lower portion of the second chamber below the surface of the water therein, said means carrying at least one finger controllable air admitting orifice means, and mouthpiece means carried by the upper portion of the second chamber, so that a smoker may apply suction to the interiors of the first and second chambers.

15. A water pipe or bong comprising:

a chamber adapted to contain water and forming with the surface of the water a generally closed liquid free space above the water, an upwardly disposed bowl for combusting therein a suitable smoke producing substance, first tubular means directing smoke from the bowl to the interior of the first chamber below the surface of the water therein, a substantially cylindrical vertically disposed tubular member mounted sealably upon a base, so that water may be contained in a lowermost portion thereof and the walls of the member form with the surface of the water a generally closed liquid free space thereabove, second tubular means directing smoke from the free space above the water of the first chamber to the lowermost portion of the tubular member below the surface of the water therein, third tubular means directing atmospheric air to the lowermost portion of the tubular member below the surface of the water therein, and mouthpiece means carried by the upper portion of the tubular member, so that a smoker may apply suction to the interiors of the chamber and the vertically disposed tubular member.

16. The apparatus of claim 15 wherein:

the uppermost extension of the member is truncated perpendicular to the logitudinal axis of the member, so that the walls of the member form a planar mouthpiece.

17. The apparatus of claim 15 wherein:

the uppermost extension of the member is shaped so that the walls of the member form a mouthpiece comfortably comforming to the face around the mouth of the smoker.

18. The apparatus of claim 15 wherein:

the uppermost extension of the tubular member is shaped to accept the mouth of the smoker therearound.

19. The apparatus of claim 15 wherein:

the first chamber is mounted upon the base of the tubular member, said base being of a size and extension rendering the water pipe free standing.

20. The apparatus of claim 15 wherein:

the chamber comprises a vertically disposed substantially cylindrical member sealably mounted upon an extension of the base of the tubular member of claim 15.

21. The apparatus of claim 15 wherein:

the chamber and the tubular member are comprised of transparent plastic material.

22. The apparatus of claim 15 wherein:

the first, second and third tubular means are comprised of transparent plastic material.

23. The apparatus of claim 15 wherein:

the third tubular means is of a size to provide substantially greater fluid flow area and therefore substantially less resistance to fluid flow than provided by the first tubular means, so that the flow of smoke is substantially completely terminated when the third tubular means is opened to the free flow of atmospheric air therethrough.

24. A waterpipe or bong comprising:

a chamber having a lower portion adapted to contain water and an upper portion adapted to form with the surface of the water a liquid free generally enclosed space for collecting and containing smoke, an upwardly disposed bowl wherein a suitable substance may be combusted to produce smoke, the bowl carrying a lower outlet controlling the smoke which may be drawn therethrough, tubular means for the smoker to selectively cause smoke from the bowl and air from the atmosphere to be directed sequentially or simultaneously to the interior of the chamber below the surface of the water therein, said means carrying at least one finger controllable orifice controlling the air admitted to the chamber, the orifice being very large in relation to the smoke outlet of the bowl and admitting the air to the chamber when partially or completely open and excluding the air from the chamber when completely closed, and mouthpiece means carried by the upper portion of the chamber, so that the smoker may apply suction to the interior of the chamber.

* * * * *